US006827641B2

(12) United States Patent
Yoshida et al.

(10) Patent No.: US 6,827,641 B2
(45) Date of Patent: Dec. 7, 2004

(54) GRINDING WHEEL HAVING SYNTHETIC RESIN LAYERS COVERING AXIALLY OPPOSITE END FACES OF BODY OF THE WHEEL

(75) Inventors: Kazumasa Yoshida, Niwa-gun (JP); Takashi Nomura, Nagoya (JP)

(73) Assignee: Noritake Co., Ltd., Nagoya (JP)

( * ) Notice: Subject to any disclaimer, the term of this patent is extended or adjusted under 35 U.S.C. 154(b) by 0 days.

(21) Appl. No.: 10/376,619

(22) Filed: Mar. 3, 2003

(65) Prior Publication Data

US 2003/0176157 A1 Sep. 18, 2003

(30) Foreign Application Priority Data

Mar. 5, 2002 (JP) ..... 2002-059143

(51) Int. Cl.[7] ..... B23F 21/03

(52) U.S. Cl. ..... 451/544; 451/541; 451/542; 451/546; 451/547

(58) Field of Search ..... 451/544, 541, 451/542, 546, 547

(56) References Cited

U.S. PATENT DOCUMENTS 3,641,718 A * 2/1972 Ferchland ..... 451/488
3,802,130 A * 4/1974 Lindenbeck ..... 451/544
4,989,375 A 2/1991 Henmi et al. ..... 51/209
6,358,133 B1 * 3/2002 Cesena et al. ..... 451/450
6,506,103 B1 * 1/2003 Ohmori et al. ..... 451/72
6,685,755 B2 * 2/2004 Ramanath et al. ..... 51/296

FOREIGN PATENT DOCUMENTS

| | | |
|---|---|---|
| JP | B1 55-36468 | 9/1980 |
| JP | A 11-42564 | 2/1999 |
| JP | A 2001-38640 | 2/2001 |

* cited by examiner

*Primary Examiner*—Joseph J. Hail, III
*Assistant Examiner*—Alvin J Grant
(74) *Attorney, Agent, or Firm*—Oliff & Berridge, PLC

(57) ABSTRACT

A grinding wheel including (a) a cylindrical main body having a grinding surface on its outer circumferential surface, and (b) a pair of synthetic resin layers disposed on respective axially opposite end faces of the cylindrical main body. Each of the synthetic resin layers covers at least a radially outer end portion of a corresponding one of the axially opposite end faces. The cylindrical main body has an abrasive layer which constitutes a radially outermost layer thereof so that the abrasive layer provides the grinding surface.

9 Claims, 3 Drawing Sheets

GRINDING WHEEL HAVING SYNTHETIC RESIN LAYERS COVERING AXIALLY OPPOSITE END FACES OF BODY OF THE WHEEL

BACKGROUND OF THE INVENTION

1. Field of the Invention

The present invention relates in general to improvements in a grindstone or grinding wheel to be used in a thru-feed centerless grinding operation.

2. Discussion of the Related Art

As a type of industrial grindstone, there is known a grinding wheel which is to be brought into sliding contact with a workpiece while being rotated about its axis, so that a surface of the workpiece is ground by an abrasive layer which is provided by an outer circumferential surface of the grinding wheel. The abrasive layer has a longer service life where the abrasive layer is formed of so-called "super abrasive grains" such as diamond abrasive grains and CBN (cubic boron nitrides) abrasive grains, than where the abrasive layer is formed of standard abrasive grains such as alumina abrasive grains and silicone carbide abrasive grains. Where the abrasive layer is formed of the super abrasive grains, the abrasive layer has a relatively small thickness, in general, due to a relative expensiveness of the super abrasive grains. In recent years, the grinding wheel having the abrasive layer formed of the super abrasive grains is widely used, thereby contributing to an unmanned or automated grinding operation in a machining industry. Therefore, the grinding wheel of the super abrasive grains is employed in various fields of industry, and is an object of further research and development for further improvement of its grinding performance.

As an example of a grinding operation in which the above-described grinding wheel is employed, there is known a centerless grinding operation in which a cylindrical workpiece is not supported on its centers but rather by a work rest blade, a regulating wheel and the grinding wheel, so that the cylindrical workpiece is ground mainly at its outer circumferential surface by the grinding wheel. FIG. 1 is a view illustrating a thru-feed centerless grinding operation in which cylindrical workpieces 14 are successively fed to a grinding zone in which each of the workpieces 14 is actually ground at its outer circumferential surface by the grinding wheel in the form of a segment-chip-type grinding wheel 10. The workpieces 14, which are disposed on the work rest blade 18 (which is positioned between the grinding wheel 10 and the regulating wheel 12) and are guided by work rest guides 16, are successively moved or fed in a predetermined feed direction, i.e., a longitudinal direction as indicated by the arrow, while being gripped by and between the grinding wheel 10 and the regulating wheel 12. In this instance, the regulating wheel 12 and the grinding wheel 10 are rotated in the same direction, namely, the clockwise direction as seen in the above-described feed direction. Described more specifically, the regulating wheel 12 is rotated for rotating workpieces 14 at a relatively low speed, while the grinding wheel 10 is rotated at a relatively high speed, whereby the outer circumferential surfaces of the workpieces 14 are grounded by an abrasive layer provided by an outer circumferential surface of the grinding wheel 10.

In the above-described thru-feed centerless grinding operation, the workpieces 14 are fed at a feed rate of, for example, about 5–10 m/min in the feed direction indicated by the arrow. The work rest guides 16 guiding the workpieces 14 are positioned in the upstream and downstream sides of the wheels 10, 12 as viewed in the feed direction. Each of the work rest guides 16 is not held in contact with the wheels 10, 12 but is necessarily spaced apart from the wheels 10, 12 as viewed in the feed direction. Due to the spacing region between an upstream side one of the work rest guides 16 and the wheels 10, 12, each workpiece 14 fed in the feed direction could be momentarily shaken or oscillated in a direction perpendicular to the feed direction, when the workpiece 14 is passing an entrance of the grinding zone, i.e., an upstream end portion of the grinding wheel 10. Upon initiation of contact of the workpiece 14 (at its forward end portion) with the grinding wheel 10, the grinding wheel 10 receives at its upstream end portion an impact or shock from the workpiece 14, thereby possibly causing a large amount of wear in the upstream end portion of the grinding wheel 10. Similarly, due to the spacing region between a downstream side one of the work rest guides 16 and the wheels 10, 12, each workpiece 14 could be oscillated when the workpiece 14 is passing an exit of the grinding zone, i.e., a downstream end portion of the grinding wheel 10. This shaking or oscillating motion of the workpiece 14 in the exit of the grinding zone is likely to cause a deterioration in a machining accuracy of the grinding operation.

SUMMARY OF THE INVENTION

The present invention was made in the light of the background art discussed above. It is therefore an object of the present invention to provide a cylindrical grindstone or grinding wheel which is capable of grinding a workpiece with a high degree of machining accuracy without suffering from a large amount of wear in its local portion. This object of the invention may be achieved according to any one of the first through tenth aspects of the invention which are described below.

The first aspect of this invention provides a grinding wheel comprising: a cylindrical main body having a grinding surface on an outer circumferential surface thereof; and a pair of synthetic resin layers disposed on respective axially opposite end faces of the cylindrical main body, each of the synthetic resin layers covering at least a radially outer end or peripheral portion of a corresponding one of the axially opposite end faces.

In the grinding wheel according to this first aspect of the invention, the synthetic resin layers are provided on the respective axially opposite end faces of the cylindrical main body such that each of the synthetic resin layers covers at least the radially outer end portion of the corresponding one of the axially opposite end faces. This arrangement is advantageous in the above-described thru-feed centerless grinding operation, because the synthetic resin layers serve to reduce the problematic oscillating motion of the workpiece upon its entrance into the grinding zone and also upon its exit from the grinding zone, thereby making it possible to grind the workpiece with a high degree of machining accuracy without suffering from a large amount of wear in a local portion of the grinding wheel.

According to the second aspect of the invention, in the grinding wheel defined in the first aspect of the invention, the cylindrical main body has an abrasive layer which constitutes a radially outermost layer thereof so that the abrasive layer provides the grinding surface.

According to the third aspect of the invention, in the grinding wheel defined in the second aspect of the invention, each of the synthetic resin layers has an elastic modulus lower than that of the abrasive layer.

According to the fourth aspect of the invention, in the grinding wheel defined in any one of the first through third aspects of the invention, the synthetic resin layers have respective elastic moduli which are different from each other.

In the thru-feed centerless grinding operation, a position of the regulating wheel relative to the grinding wheel may be adjusted such that a spacing distance between the two wheels is not constant as viewed in the feed direction. For example, the spacing distance may be larger in the entrance of the grinding zone, than in the exit of the grinding zone, so that the diameter of the workpiece is gradually reduced as the workpiece is fed through the grinding zone in the feed direction. In this case, the diameter of the workpiece is approximated to a target dimension by grinding the workpiece with the upstream end and intermediate portions of the grinding wheel, and then the diameter is reduced precisely to the target dimension by grinding the workpiece with the downstream end portion of the grinding wheel. In such a case, it is preferable that the grinding wheel is set on a grinding machine such that one of the synthetic resin layers having relatively low degree of elastic modulus is positioned in an upstream side of the other synthetic resin layer (having relatively high degree of elastic modulus) as viewed in the feed direction. In this preferable arrangement, owing to this setting of the grinding wheel on the grinding machine, the shaking or oscillating motion of the workpiece in the entrance of the grinding zone is reduced by the upstream-side synthetic resin layer having the relatively low degree of elastic modulus, and the machining accuracy of the workpiece is improved by the downstream-side synthetic resin layer having the relatively high degree of elastic modulus.

According to the fifth aspect of the invention, in the grinding wheel defined in any one of the first through fourth aspects of the invention, each of the synthetic resin layers contains a ceramic material as an aggregate thereof. In this arrangement, each of the synthetic resin layers can be given a desired degree of elastic modulus, by changing the content of the ceramic material.

According to the sixth aspect of the invention, in the grinding wheel defined in any one of the first through fifth aspects of the invention, each of the synthetic resin layers includes a phenol resin as a main component thereof. Since the phenol resin is of a synthetic resin material that is excellent in its heat resistance, elasticity and mechanical strength, it is possible to more effectively minimize an abnormal wear in a local portion of the abrasive layer, and further improve a machining accuracy in a grinding operation.

According to the seventh aspect of the invention, in the grinding wheel defined in any one of the first through sixth aspects of the invention, each of the synthetic resin layers has an elastic modulus of 300–6000 kg/cm$^2$.

According to the eighth aspect of the invention, in the grinding wheel defined in any one of the first through seventh aspects of the invention, each of the synthetic resin layers is provided by an annular member having an outer circumferential surface which has an outside diameter equal to an outside diameter of the outer circumferential surface of the cylindrical main body and which is coaxial with the outer circumferential surface of the cylindrical main body.

According to the ninth aspect of the invention, in the grinding wheel defined in the eighth aspect of the invention, the cylindrical main body has, in respective axially opposite end portions thereof, small diameter portions each of which has an outside diameter equal to an inside diameter of a corresponding one of the synthetic resin layers, and which has an axial length equal to an axial length of the corresponding one of the synthetic resin layers, so that the synthetic resin layers are mounted on the respective axially opposite end portions of the cylindrical body.

According to the tenth aspect of the invention, in the grinding wheel defined in any one of the second through ninth aspects of the invention, the cylindrical body includes a cylindrical core body and a plurality of abrasive segment chips which are fixed to an outer circumferential surface of the cylindrical core body and which cooperate with each other to constitute the abrasive layer.

BRIEF DESCRIPTION OF THE DRAWINGS

The above and other objects, features, advantages and technical and industrial significance of this invention will be better understood by reading the following detailed description of the presently preferred embodiment of the invention, when considered in connection with the accompanying drawings, in which.

DETAILED DESCRIPTION OF THE PREFERRED EMBODIMENT

The preferred embodiment of the present invention will be described in detail by reference to the accompanying drawings. It is to be understood, however, that FIGS. 2–4 do not necessarily show various parts or elements, with exact representation of ratios of their dimensions.

Figure 2A:
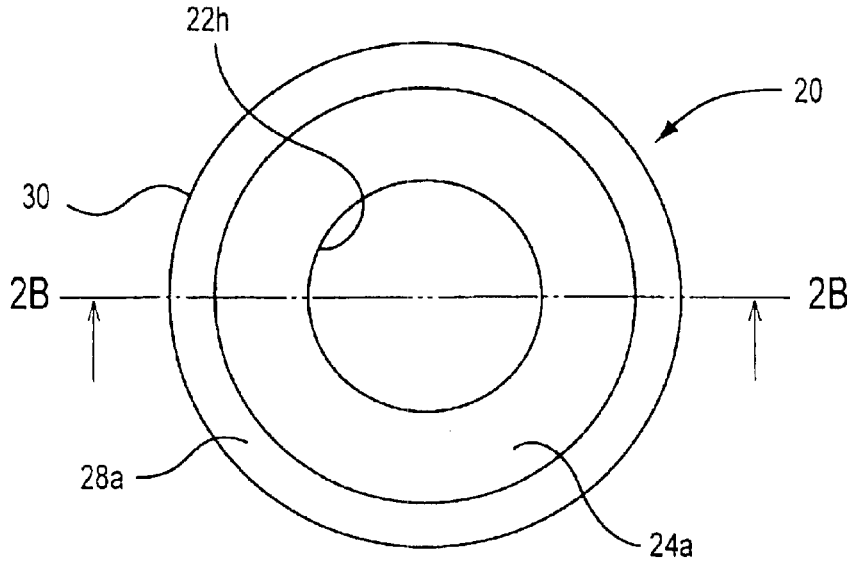
FIG. 2A is a plan view of a segment-chip-type grinding wheel constructed according to an embodiment of the invention, as seen in a direction perpendicular to an axial end face of the grinding wheel.
Figure 2B:
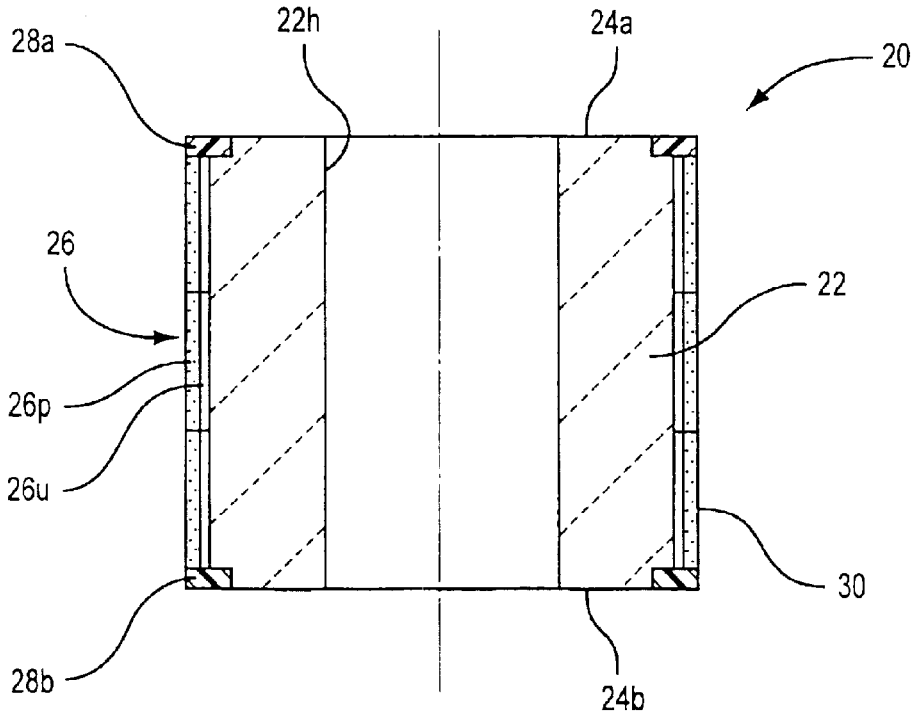
FIG. 2B is a cross sectional view taken along line 2B—2B of FIG. 2A.

FIGS. 2A and 2B show a segment-chip-type grinding wheel 20 which is constructed according to an embodiment of this invention. FIG. 2A is a plan view of the grinding wheel 20 as seen in a direction perpendicular to an axial end face (bottom face) 24*a*, while FIG. 2B is a cross sectional view taken along line 2B—2B of FIG. 2A. As is apparent from FIGS. 2A and 2B, the grinding wheel 20 includes: a cylindrical core body 22 which has a central mounting hole 22*h* formed therethrough; a plurality of arcuate or part-cylindrical abrasive segment chips 26 which are bonded to an outer circumferential surface of the cylindrical core body 22 and which cooperate with each other to constitute an abrasive layer; and a pair of synthetic resin layers 28*a*, 28*b* which are fixed to the respective axially opposite end faces 24*a*, 24*b* so as to cover at least radially outer end or peripheral portions of the respective axially opposite end faces 24*a*, 24*b*. In the present embodiment, the grinding wheel 20 has an outside diameter of 400 mm, an axial length of 200 mm and an inside diameter (diameter of the mounting hole 22*h*) of 200 mm. This grinding wheel 20 is installed on a grinding machine, by introducing a wheel spindle of the machine into the mounting hole 22*h*. As the grinding wheel 20 is rotated about its axis, a workpiece is ground by a cylindrical grinding surface 30 provided by the abrasive layer.

The cylindrical core body 22 is made of a material as used in a conventional alumina grindstone or silicon carbide grindstone, namely, made of alumina abrasives or silicone carbide abrasives which are bonded together with a vitrified bonding agent. In the present embodiment, the cylindrical core body 22 cooperates with the abrasive segment chips 26 to constitute a cylindrical main body of the grinding wheel 20. As shown in FIG. 2B, each of the synthetic resin layers 28*a*, 28*b* provided by an annular member has an outer circumferential surface which has an outside diameter equal to an outside diameter of the outer circumferential surface of the cylindrical main body, and which is coaxial with the outer circumferential surface of the cylindrical main body. The cylindrical main body has, in its respective axially opposite end portions, small diameter portions each of which has an outside diameter equal to an inside diameter of the corresponding one of the synthetic resin layers 28*a*, 28*b*, and each of which has an axial length equal to an axial length of the corresponding one of the synthetic resin layers 28*a*, 28*b*, so that the synthetic resin layers 28*a*, 28*b* are mounted on the respective small diameter portions of the cylindrical main body. Thus, the cylindrical main body cooperates with the synthetic resin layers 28*a*, 28*b* to constitute an outer circumferential surface of the grinding wheel 20 which is constant in its diameter over the entire axial length of the grinding wheel 20, and axially opposite end faces of the grinding wheel 20 each of which is provided by a single flat surface.

Each of the part-cylindrical abrasive segment chips 26 has a radially inner portion in the form of a base portion 26*u* which is bonded to the outer circumferential surface of the cylindrical core body 22, and a radially outer portion in the form of an abrasive portion 26*p* which is to be brought into contact with a workpiece during a grinding operation with the grinding wheel 20. The base portion 26*u* is formed of mullite or other ceramic material. The abrasive portion 26*p* is formed of super abrasive grains, such as diamond abrasive grains and CBN (cubic boron nitride) abrasive grains, which are held together by a vitrified bond or other bonding agent. The abrasive portions 26*p* of the segment chips 26 cooperate with each other to constitute the above-described abrasive layer. In other words, the radially outer surfaces of the abrasive portions 26*p* cooperate with each other to form the cylindrical grinding surface 30 of the grinding wheel 20.

Figure 1:
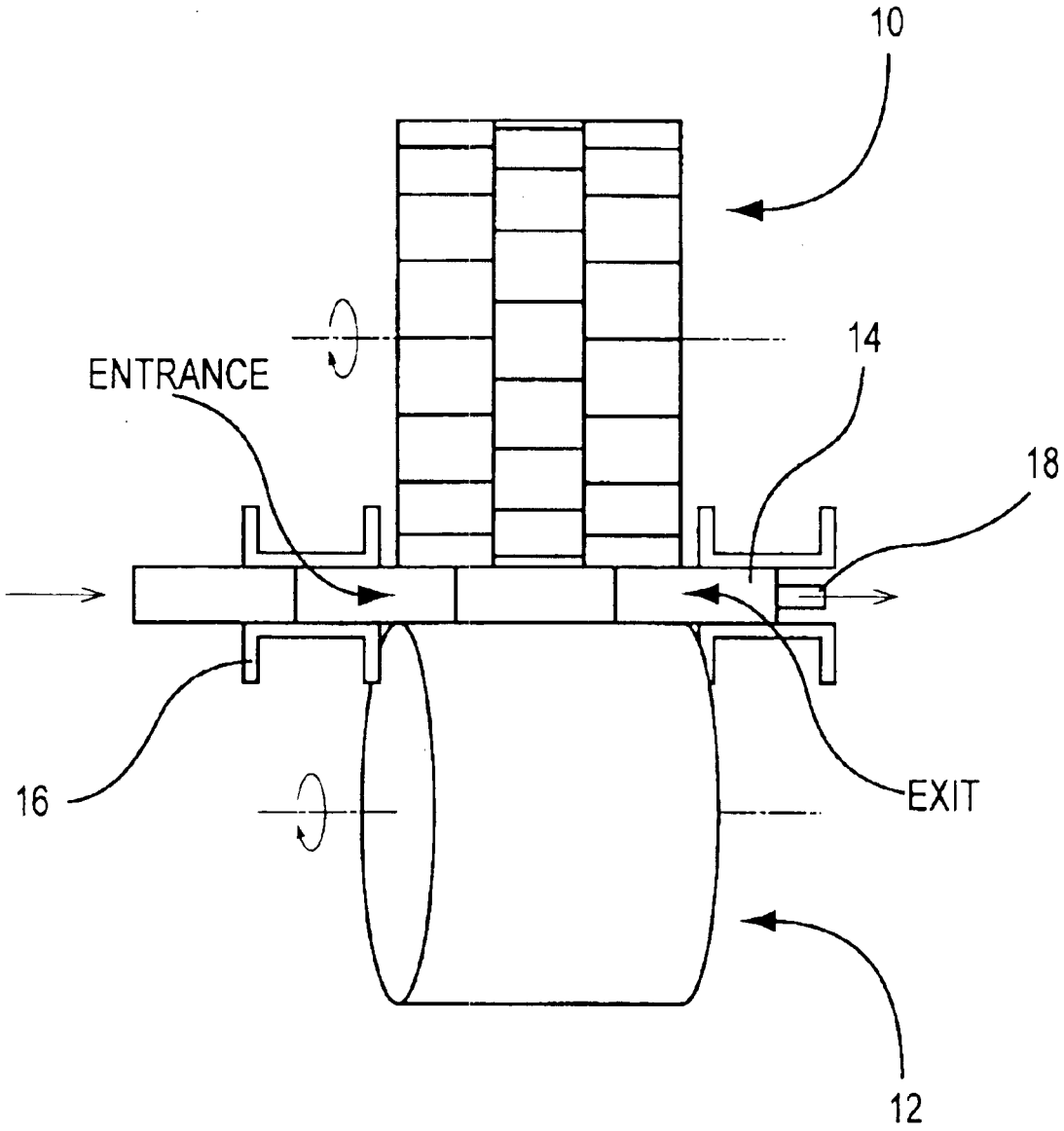
FIG. 1 is a view schematically showing a thru-feed centerless grinding operation in which a segment-chip-type grinding wheel is used.

Each of the synthetic resin layers 28*a*, 28*b* is formed principally of a phenol resin or other synthetic resin, and has an outside diameter of 400 mm, an axial length (thickness) of 5 mm and an inside diameter of 380 mm. An elastic modulus of each of the synthetic resin layers 28*a*, 28*b* has to be lower than that of the abrasive layer (i.e., the abrasive portions 26*p* of the segment chips 26), for avoiding formation of a step or shoulder at a boundary between the segment chips 26 and the synthetic resin layer 28*a* or 28*b* in a dressing operation, and also for minimizing the above-described oscillating motion of the workpiece in a grinding operation. In this sense, the elastic modulus of each of the synthetic resin layers 28*a*, 28*b* is preferably 300–6000 kg/cm$^2$. Further, the synthetic resin layers 28*a*, 28*b* have respective mechanical properties different from each other. Desired properties of the synthetic resin layers 28*a*, 28*b* vary depending upon type of grinding operation in which the grinding wheel 20 is employed. In the present embodiment, the synthetic resin layer 28*a* has a transverse strength of about 1100 kg/cm$^2$, a flexural modulus of about 600 kg/cm$^2$ and a Rockwell hardness (defined by JIS) of about 90 HRF, while the synthetic resin layer 28*b* has a transverse strength of about 1500 kg/cm$^2$, a flexural modulus of about 2300 kg/cm$^2$ and a Rockwell hardness (defined by JIS) of about 105 HRF. Among these properties of the synthetic resin layers 28*a*, 28*b*, the value of the elastic or flexural modulus is the most important. A ratio of the elastic or flexural modulus of the synthetic resin layer 28*b* to that of the synthetic resin layer 28*a* is preferably 2–5, and is more preferably 3–4. Further, each of the synthetic resin layers 28*a*, 28*b* preferably contains, as its aggregate, alumina abrasive grains, silicone carbide abrasive grains or other ceramic material such as mullite and cordierite, so that each of the synthetic resin layers 28*a*, 28*b* can be given a desired degree of elastic modulus, by controlling the content of the ceramic material.

Where the grinding wheel 20 is used in a thru-feed centerless grinding operation as shown in FIG. 1, a wheel having the same axial length as the grinding wheel 20 is used as the regulating wheel 12. For permitting the workpiece 14 to be easily fed into and out from the grinding zone (defined by the two mutually opposed wheels 20, 12) at the entrance and exit of the grinding zone, the two wheels 20, 12 are aligned with each other in the feed direction. In such a thru-feed centerless grinding operation, a position of the regulating wheel 12 relative to the grinding wheel 20 may be adjusted such that a spacing distance between the two wheels 20, 12 is not constant as viewed in the feed direction. For example, the spacing distance may be larger in the entrance of the grinding zone, than in the exit of the grinding zone, so that the diameter of the workpiece 14 is gradually reduced as the workpiece 14 is fed through the grinding zone in the feed direction. In this case, the diameter of the workpiece 14 is approximated to a target dimension by grinding the workpiece 14 with the upstream end and intermediate portions of the grinding wheel 20, and then the diameter is reduced precisely to the target dimension by grinding the workpiece 14 with the downstream end portion of the grinding wheel 20. In such a case, it is preferable that the grinding wheel 20 is set on a grinding machine such that the synthetic resin layer 28*a* having the relatively low degree of elastic modulus is positioned in the entrance of the grinding zone while the synthetic resin layer 28*b* having the relatively high degree of elastic modulus is positioned in the exit of the grinding zone. In the entrance of the grinding zone in which the spacing distance is relatively large, the workpiece 14 is likely to be oscillated, thereby causing a risk of an abnormal wear, chipping or cracking of the upstream end portion of the grinding wheel 20. Such a risk can be minimized, since the oscillating motion of the workpiece 14 in the entrance of the grinding zone is reduced by the synthetic resin layer 28*a* having the relatively low degree of elastic modulus. In the exit of the grinding zone in which the spacing distance is relatively small, the workpiece 14 can be fed out of the grinding zone without deteriorating its machining accuracy, owing to the synthetic resin layer 28*a* having the relatively high degree of elastic modulus.

A relatively large-sized grinding wheel like the grinding wheel 20 necessarily has a large weight. Due to the large weight, there might be a risk of brakeage or cracking of the peripheral portion of the axial end face 24*a* or 24*b*, if the grinding wheel 20 is accidentally dropped or brought into contact with an object, for example, during an operation for mounting or demounting the grinding wheel 20 on or from a grinding machine. However, such a brakeage or cracking of the grinding wheel 20 can be prevented by the synthetic resin layers 28*a*, 28*b* which cover the radially outer end or peripheral portions of the axial end faces 24*a*, 24*b*. That is, as another technical advantage provided by the provisions of the synthetic resin layers 28*a*, 28*b*, a brakeage or cracking of the grinding wheel 20 can be prevented in the event of an accidental dropping or contact of the wheel 20 with an object.

There will be described an experiment which was conducted by the present inventors for verifying technical advantages or effects of the present invention. In the experiment, three type of synthetic resin layers $T_1$, $T_2$, $T_3$ were prepared with different mixing ratios between the phenol resin and the silicone carbide abrasive grains (as aggregate), so that the synthetic resin layers $T_1$, $T_2$, $T_3$ had respective elastic moduli different from each other. Then, four grinding wheels of Samples $TH_1$, $TH_2$, $TH_3$, $TH_4$ were prepared such that Sample $TH_1$ was not provided with any synthetic resin layer, Sample $TH_2$ was provided with the synthetic resin layers $T_1$, $T_2$, Sample $TH_3$ was provided with the two synthetic resin layers $T_2$, and Sample $TH_4$ was provided with the synthetic resin layers $T_2$, $T_3$. By using these grinding wheels of Samples $TH_1$, $TH_2$, $TH_3$, $TH_4$, a thru-feed grinding operation as shown in FIG. 1 was executed. In the grinding operation, a large number of cylindrical workpieces were successively are ground such that each workpiece was ground until its diameter was reduced by 50 $\mu$m. After the grinding operation, it was checked whether each of Samples $TH_1$, $TH_2$, $TH_3$, $TH_4$ suffered from an abnormal wear. The construction of the synthetic resin layers $T_1$, $T_2$, $T_3$ and Samples $TH_1$, $TH_2$, $TH_3$, $TH_4$, and the grinding conditions are as follows:

[Construction of Synthetic Resin Layers]

| | Elastic Modulus ($kg/cm^2$) | Mixing Ratio (vol. %) Silicone Carbide Abrasive Grains | Phenol resin |
|---|---|---|---|
| Synthetic Resin Layer $T_1$ | 4000 | 80 | 20 |
| Synthetic Resin Layer $T_2$ | 2300 | 50 | 50 |
| Synthetic Resin Layer $T_3$ | 600 | 10 | 90 |
| Abrasive Segment Chips | 8000 | — | — |

[Construction of Grinding Wheels]

| | Upstream-side Synthetic Resin Layer | Downstream-side Synthetic Resin Layer |
|---|---|---|
| Sample $TH_1$ | No | No |
| Sample $TH_2$ | Synthetic Resin Layer $T_1$ | Synthetic Resin Layer $T_2$ |
| Sample $TH_3$ | Synthetic Resin Layer $T_2$ | Synthetic Resin Layer $T_2$ |
| Sample $TH_4$ | Synthetic Resin Layer $T_3$ | Synthetic Resin Layer $T_2$ |

[Conditions]

| | |
|---|---|
| Dimensions of Grinding Wheels | 405 mm (outside diameter) × 200 mm (axial length) × 203.2 mm (inside diameter) |
| Dimensions of Workpiece | 10 mm (outside diameter) × 30 mm (axial length) |
| Material of Workpiece | SUJ 2 |
| Feed Rate of Workpiece | 5 m/min. |

Figure 3:
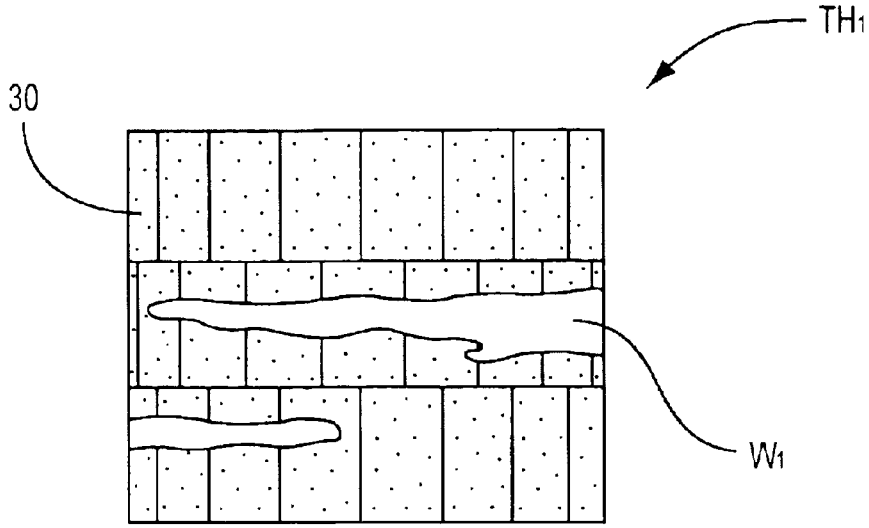
FIG. 3 is a view explaining an abnormal wear caused in a grinding surface of Sample $TH_1$ during a grinding test.
Figure 4:
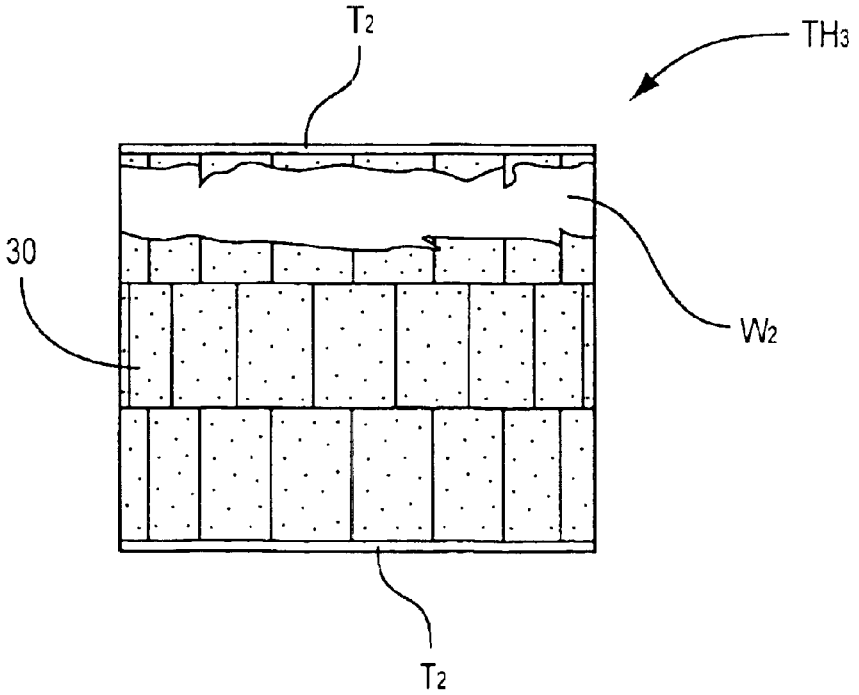
FIG. 4 is a view explaining an abnormal wear caused in a grinding surface of Sample $TH_3$ during a grinding test.

In Sample $TH_1$, an abnormal wear $W_1$ appeared in the axially intermediate portion of the grinding surface 30, as shown in FIG. 3, after 1000 workpieces had been ground by this grinding wheel. That is, the abrasive portions 26*p* of the segment chips 26 located in the axially intermediate portion of the grinding surface 30 were worn out or eliminated so that the base portions 26*u* or the core body 22 became exposed. In Sample $TH_2$, a cracking occurred in the abrasive portions 26*p* of the abrasive segment chips 26 located in the upstream end portion of the grinding surface 30, after 5000 workpieces had been ground by this grinding wheel. Sample $TH_3$ did not suffer from any problem in the grinding operation in which the workpieces are fed at the feed rate of 5 m/min. However, Sample $TH_3$ suffered from an abnormal wear $W_2$ appearing in the upstream end portion of the grinding surface 30, as shown in FIG. 4, after 3000 workpieces had been ground with the workpieces being fed at an increased feed rate of 10 m/min. Sample $TH_4$ did not suffer from any problem in the grinding operation even after a lager number of workpieces, i.e., 10000 workpieces had been ground, and exhibited a satisfactory grinding performance even after the feed rate of the workpieces had been increased to 10/min.

Thus, the experiment revealed that the abrasive layer of the grinding wheel 20 is advantageously prevented from being problematically worn or broken in a grinding operation, owing to the provision of the synthetic resin layers 28*a*, 28*b* having the appropriate elastic moduli. Further, it was confirmed that the problematic wear or breakage is further reliably prevented by the arrangement in which the synthetic resin layer 28*a* having the relatively low degree of elastic modulus is positioned in the entrance of the grinding zone while the synthetic resin layer 28*b* having the relatively high degree of elastic modulus is positioned in the exit of the grinding zone.

As is apparent from the above description, since the pair of synthetic resin layers 28*a*, 28*b* are provided to cover at least the radially outer end portions of the respective axially opposite end faces 24*a*, 24*b* of the cylindrical main body which is constituted by the cylindrical core body 22 and the abrasive segment chips 26 fixed to the cylindrical core body 22, it is possible to reduce or minimize the oscillating motion of the workpiece 14 as the workpiece 14 is fed into and out of the grinding zone in the thru-feed centerless grinding operation. That is, the grinding wheel 20 constructed according to this invention is capable of grinding a workpiece with a high degree of machining accuracy without suffering from a large amount of wear in its local portion.

Further, in the present embodiment, the synthetic resin layers 28*a*, 28*b* disposed on the respective axially opposite end faces 24*a*, 24*b* have the respective elastic moduli different from each other. Therefore, in the thru-feed centerless grinding operation in which the spacing distance between the grinding wheel 20 and the regulating wheel 12 is adapted to be larger in the entrance of the grinding zone than in the exit of the grinding zone, it is possible to set the grinding wheel 20 on a grinding machine such that the synthetic resin layer 28*a* having the relatively low degree of elastic modulus is positioned in the entrance of the grinding zone while the synthetic resin layer 28*b* having the relatively high degree of elastic modulus is positioned in the exit of the grinding zone. Owing to this setting of the grinding wheel 20 on the grinding machine, the shaking or oscillating motion of the workpiece 14 in the entrance of the grinding zone is reduced by the upstream-side synthetic resin layer 28*a* having the relatively low degree of elastic modulus, and the machining accuracy of the workpiece 14 is improved by the downstream-side synthetic resin layer 28*b* having the relatively high degree of elastic modulus.

Further, in the present embodiment in which each of the synthetic resin layers 28*a*, 28*b* contains the ceramic material as its aggregate, each of the synthetic resin layers 28*a*, 28*b* can be given a desired degree of elastic modulus, by changing the content of the ceramic material.

Still further, in the present embodiment, each of the synthetic resin layers 28*a*, 28*b* contains a phenol resin as its main component. Since the phenol resin is of a synthetic resin material that is excellent in its heat resistance, elasticity and mechanical strength, it is possible to more effectively minimize an abnormal wear in a local portion of the abrasive layer, and further improve a machining accuracy in a grinding operation.

While the presently preferred embodiment of the present invention has been described above with a certain degree of particularity, by reference to the accompanying drawings, it is to be understood that the invention is not limited to the details of the illustrated embodiment, but may be otherwise embodied.

In the above-described embodiment, each of the synthetic resin layers 28*a*, 28*b* is provided to cover the radially outer end portion of the corresponding one of the axially opposite end faces 24*a*, 24*b* of the cylindrical main body. However, each of the synthetic resin layers 28*a*, 28*b* may be adapted to cover the entirety of the corresponding axial end face 24*a* or 24*b*.

Further, while each of the synthetic resin layers 28*a*, 28*b* contains the phenol resin as its main component in the above-described embodiment, each synthetic resin layer 28*a*, 28*b* may contain other synthetic resin such as an epoxy resin as its main component.

In the above-described embodiment, the grinding wheel 20 is set on the grinding machine such that the synthetic resin layer 28*a* having the relatively low degree of elastic modulus is positioned in the entrance of the grinding zone while the synthetic resin layer 28*b* having the relatively high degree of elastic modulus is positioned in the exit of the grinding zone. However, where the grinding wheel 20 is used in a thru-feed centerless grinding operation in which the spacing distance between the grinding wheel 20 and the regulating wheel 12 is adapted to be larger in the exit of the grinding zone than in the entrance of the grinding zone, it is possible to set the grinding wheel 20 on a grinding machine such that the synthetic resin layer 28*b* having the relatively high degree of elastic modulus is positioned in the entrance of the grinding zone while the synthetic resin layer 28*a* having the relatively low degree of elastic modulus is positioned in the exit of the grinding zone. That is, a suitable setting of the grinding wheel 20 on a grinding machine varies depending upon the type of grinding operation. Further, the grinding wheel 20 can be used also in a thru-feed centerless grinding operation in which the spacing distance between the two wheels 20, 12 is substantially constant rather than being changed as viewed in the feed direction.

While the abrasive portion 26*p* of each segment chip 26 is formed of the super abrasive grains such as the diamond abrasive grains and CBN abrasive grains in the above-described embodiment, the abrasive portion 26*p* may be formed of standard abrasive grains such as alumina abrasive grains and silicone carbide abrasive grains.

While the abrasive grains of the abrasive portion 26*p* are held together by a vitrified bonding agent in the above-described embodiment, the abrasive grains of the abrasive portion 26*p* may be held together by other bonding agent such as a synthetic resin bonding agent.

While the cylindrical core body 22 is formed of the alumina abrasives or silicone carbide abrasives which are bonded together with a vitrified bonding agent in the above-described embodiment, this core body 22 may be made of other material such as a synthetic resin or metallic material.

In the above-described embodiment, the cylindrical main body of the grinding wheel 20 is constituted by the cylindrical core body 22 and the abrasive segment chips 26 which are fixed to the core body 22. However, this cylindrical main body may be provided by a single piece. In that case, the core body 22 and the abrasive portion 26*p* of the each segment chip 26 are constituted by the same composition.

In the above-described embodiment, an axial end face of each of the synthetic resin layers 28*a*, 28*b* is flush with the axial end face 24*a* or 24*b* of the core body 22. However, the synthetic resin layer 28*a* or 28*b* may be outwardly protruded from the core body 22 as viewed in the axial direction, or alternatively, the core body 22 may be outwardly protruded from the synthetic resin layer. 28*a* or 28*b* as viewed in the axial direction.

While the presently preferred embodiment of the present invention has been illustrated above, it is to be understood that the invention is not limited to the details of the illustrated embodiment, but may be embodied with various other changes, modifications and improvements, which may occur to those skilled in the art, without departing from the spirit and scope of the invention defined in the following claims.

What is claimed is:

1. A grinding wheel comprising:

a cylindrical main body having a grinding surface on an outer circumferential surface thereof; and a pair of synthetic resin layers disposed on respective axially opposite end faces of said cylindrical main body, each of said synthetic resin layers covering at least a radially outer end portion of a corresponding one of said axially opposite end faces, wherein said cylindrical main body has an abrasive layer which constitutes a radially outermost layer thereof so that said abrasive layer provides said grinding surface, and wherein each of said synthetic resin layers has an elastic modulus lower than that of said abrasive layer.

2. A grinding wheel comprising:

a cylindrical main body having a grinding surface on an outer circumferential surface thereof; and a pair of synthetic resin layers disposed on respective axially opposite end faces of said cylindrical main body, each of said synthetic resin layers covering at least a radially outer end portion of a corresponding one of said axially opposite end faces, wherein said synthetic resin layers have respective elastic moduli which are different from each other.

3. A grinding wheel according to claim 2, wherein said cylindrical main body has an abrasive layer which constitutes a radially outermost layer thereof so that said abrasive layer provides said grinding surface.

4. A grinding wheel according to claim 3, wherein said cylindrical main body includes a cylindrical core body and a plurality of abrasive segment chips which are fixed to an outer circumferential surface of said cylindrical core body and which cooperate with each other to constitute said abrasive layer.

5. A grinding wheel according to claim 2, wherein each of said synthetic resin layers contains a ceramic material as an aggregate thereof.

6. A grinding wheel according to claim 2, wherein each of said synthetic resin layers contains a phenol resin as a main component thereof.

7. A grinding wheel according to claim 2, wherein each of said synthetic resin layers is provided by an annular member having an outer circumferential surface which has an outside diameter equal to an outside diameter of said outer circumferential surface of said cylindrical main body and which is coaxial with said outer circumferential surface of said cylindrical main body.

8. A grinding wheel according to claim 7, wherein said cylindrical main body has, in respective axially opposite end portions thereof, small diameter portions each of which has an outside diameter equal to an inside diameter of a corresponding one of said synthetic resin layers, and each of which has an axial length equal to an axial length of the corresponding one of said synthetic resin layers, so that said synthetic resin layers are mounted on the respective small diameter portions of said cylindrical main body.

9. A grinding wheel comprising:

a cylindrical main body having a grinding surface on an outer circumferential surface thereof; and a pair of synthetic resin layers disposed on respective axially opposite end faces of said cylindrical main body, each of said synthetic resin layers covering at least a radially outer end portion of a corresponding one of said axially opposite end faces, wherein each of said synthetic resin layers has an elastic modulus of 300–6000 $kg/cm^2$.

* * * * *